United States Patent [19]

Reinholz

[11] Patent Number: 4,655,346

[45] Date of Patent: Apr. 7, 1987

[54] SELF-STANDING GOLF BAG

[76] Inventor: Orville A. Reinholz, 4899 Campbell Ave., Apt. #1, San Jose, Calif. 95130

[21] Appl. No.: 766,484

[22] Filed: Aug. 19, 1985

[51] Int. Cl.[4] ..... A63B 55/00; A63B 55/06

[52] U.S. Cl. ..... 206/315.6; 206/315.7; 248/96

[58] Field of Search ..... 206/315.2, 315.3, 315.7, 206/315.8, 315.6, 315.5; 211/70.2; 248/96

[56] References Cited

U.S. PATENT DOCUMENTS

| | | | |
|---|---|---|---|
| D. 172,785 | 8/1954 | Eging | 206/315.3 X |
| 1,189,879 | 7/1916 | Shamberg | 206/315.6 |
| 1,555,019 | 9/1925 | MacDonald | 206/315.3 |
| 1,960,099 | 5/1934 | Donovan | 206/315.3 X |
| 2,000,711 | 5/1935 | Mobbs | 206/315.3 X |
| 2,007,709 | 7/1935 | Eppens | 206/315.3 X |
| 2,047,079 | 7/1936 | MacMurray | 206/315.6 X |
| 2,070,254 | 2/1937 | Burgner | 211/70.2 |
| 2,422,315 | 6/1947 | Robinson | 206/315.7 |
| 2,502,627 | 4/1950 | Martin | 206/315.6 |
| 2,551,780 | 5/1951 | Wood | 206/315.3 X |
| 2,661,174 | 12/1953 | Sands | 206/315.7 X |
| 3,758,061 | 9/1973 | Townhill | 206/315.3 X |
| 3,779,297 | 12/1973 | Stammer | 206/315.7 X |
| 3,842,876 | 10/1974 | Cristelli | 206/315.6 X |

FOREIGN PATENT DOCUMENTS

| | | | |
|---|---|---|---|
| 214555 | 8/1967 | Sweden | 206/315.5 |

*Primary Examiner*—William Price
*Assistant Examiner*—Sue A. Weaver
*Attorney, Agent, or Firm*—Gerald L. Moore

[57] ABSTRACT

A golf bag comprised of three longitudinal sections (11, 12, and 14) that form club compartments and are fixed together by a hinge connection (25) such that the center section (12) can be pivoted out of alignment with the side segments (11 and 14) to form a tripod configuration and render the bag self-standing.

4 Claims, 6 Drawing Figures

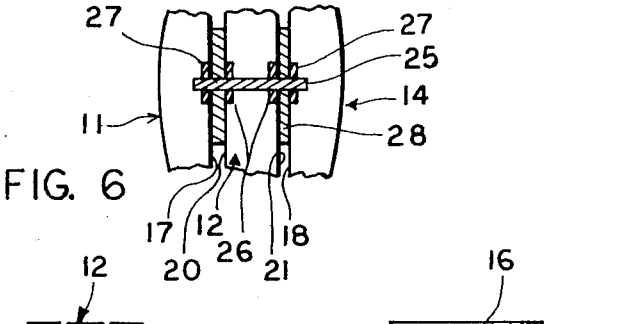
FIG. 6
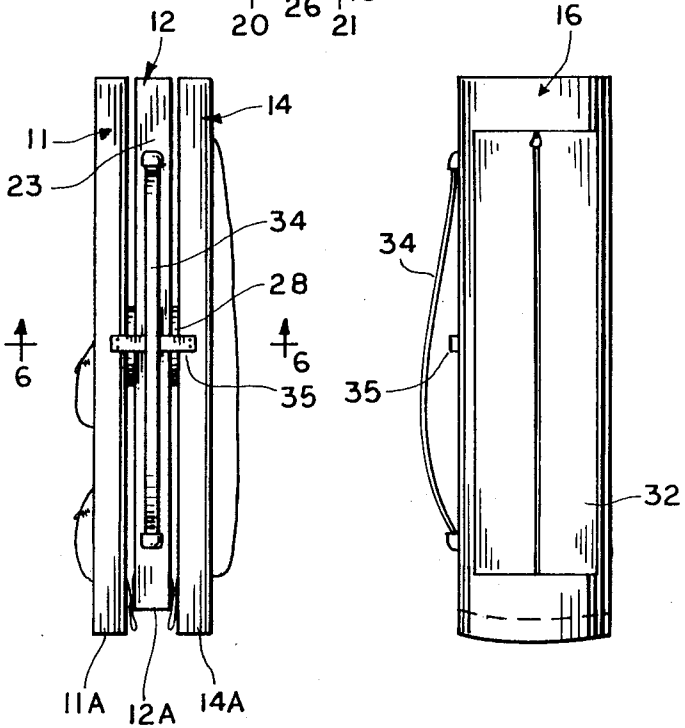
FIG. 4
FIG. 3
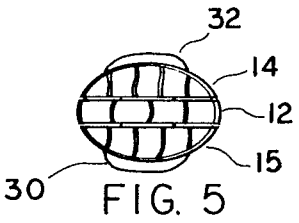
FIG. 5
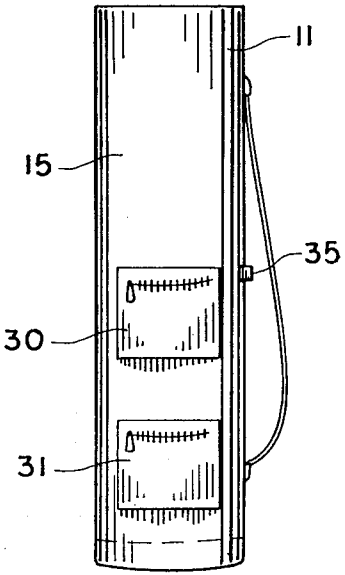
FIG. 2
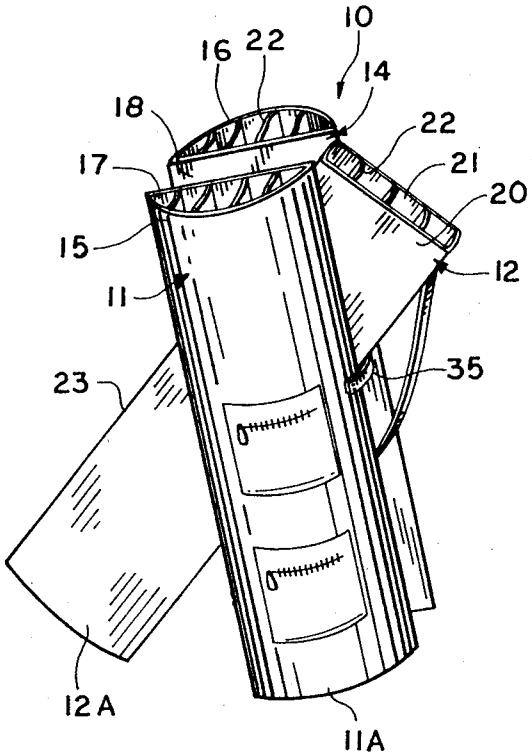
FIG. 1

SELF-STANDING GOLF BAG

FIELD OF THE INVENTION

This invention relates to a golf bag having sections hinged together and which can be pivoted apart to form a tripod configuration that allows the bag to stand alone in the vertical position.

BACKGROUND OF THE INVENTION

When playing golf, the golf bag with the unused clubs must be left alone during every shot. It is inconvenient to lay the bag on the ground during each shot. Various devices have been made for attachment to the bag and which may be folded out to support the bag in more or less the vertical position. However, these attachments usually make the bag more cumbersome and heavier to carry, and also frequently form protuberances making the bag difficult to carry.

It is the purpose of this invention to provide a golf bag that is self-supporting yet convenient to carry.

SUMMARY OF THE INVENTION

A golf bag comprising at least 3 longitudinal sections that are pivoted together, which sections when pivoted in one position form a normal bag having separate compartments for the clubs and when pivoted to a second position, form a tripod configuration allowing the bag to stand on end when unattended.

DESCRIPTION OF THE DRAWINGS

FIG. 1 is a perspective view of the bag incorporating the subject invention and standing unsupported;

FIG. 2 is a side view of the bag positioned for carrying;

FIG. 3 is another side view of the bag of FIG. 2;

FIG. 4 is yet another side view of the bag;

FIG. 5 is a top view of the bag, and

FIG. 6 is a partial cross-sectional view of the bag along the line 6—6 of FIG. 3.

DESCRIPTION OF THE INVENTION

As shown in FIG. 1, the golf bag 10 incorporating the subject invention is comprised of 3 longitudinal sections 11, 12, and 14 that are hinged together in a manner allowing the center section 12 to be pivoted outward at the bottom to a position out of alignment with the other 2 sections such that the bottom ends 11A, 12A, and 14A are spaced apart in a modified tripod configuration making the golf bag self-standing. The outer sections 11 and 14 include arcuate outer walls 15 and 16 and planar inner walls 17 and 18, respectively. The inner section 12 includes outer walls 20 and 21 which are planar and side walls 23 that are continuances of the arcuate walls 15 and 16. Each of these sections can include inner wall members 22 dividing the sections into individual club compartments.

The sections are hinged together by a single pin 25 (FIG. 6) extending normal to the walls 20 and 21, completely through the center section 12 and into the inner walls 17 and 18 respectively of the outer sections 11 and 14. If desired, the walls 20 and 21 can include the reinforcing members 26. Preferably, the pin 25 is fixed to reinforcing members 27 and is rotatably passed through the spacer members 28 separating the section 12 from the outer sections 11 and 14. The spacer between the sections holds them apart to allow for easy pivoting. The outer wall 15 can include zippered pockets 30 and 31 while the outer wall 16 preferably includes an elongated zippered pocket 32. A carrying strap 34 is fixed to one edge of the center section 12.

When the carrying strap 34 is grasped near the upper end thereof, the center section 12 is pivoted in the counter-clockwise direction (in FIG. 2) swinging the lower end 12A thereof against a brace 35 fixed to the sections 11 and 14. Thus, while carrying the bag by the strap, the sections remain in alignment because of the weight distribution. However, when the bag is set down, the center section 12, being slightly shorter than the side sections 11 and 14, allows the ends 11A and 14A to strike the ground first and, by a slight downward pull on the strap, the end 12A is pivoted around the shaft 25 to the attitude shown in FIG. 1 until the center section rests against the brace 35. Thereafter, a further lowering of the strap allows the end 12A to strike the ground placing the bag in the tripod configuration to be self supporting in a vertical position.

I claim:

1. A golf bag comprising:

three longitudinal sections comprising two outside sections and a center section positioned side-by-side with each section including a plurality of club compartments, hinge means fixing said sections together at a point intermediate the ends to allow pivoting of the center section out of alignment with the outside sections to form a tripod configuration and allow the bag to stand in the vertical attitude on the bottom ends of said sections.

2. A golf bag comprising:

three sections with each section including a plurality of club compartments, hinge means fixing said sections together to allow pivoting of at least one section relative to the other sections to form a tripod configuration and allow the bag to stand in the vertical attitude on the bottom ends of said sections, said three sections comprising two outside sections and a center section, and wherein the center section pivots out of alignment relative to the other two sections, and wherein said center section is of shorter length between the hinge means and the bottom end than the outside sections.

3. A golf bag as defined in claim 2 including a carrying strap fixed to said center section at a position causing said center section to pivot into alignment with said outside sections when the bag is lifted by said carrying strap.

4. A golf bag as defined by claim 3 including a brace connecting said side sections to hold said center section in alignment with said outside sections when the bag is lifted by said carrying strap.

* * * * *